US009834034B2

(12) United States Patent
Egan

(10) Patent No.: US 9,834,034 B2
(45) **Date of Patent: *Dec. 5, 2017**

(54) PAINT ROLLER SKIN CLEANER

(71) Applicant: PAMRICK ENTERPRISES, LLC, Rodeo, CA (US)

(72) Inventor: Patrick L. Egan, Pismo Beach, CA (US)

(73) Assignee: Pamrick Enterprises, LLC, Pismo Beach, CA (US)

( * ) Notice: Subject to any disclaimer, the term of this patent is extended or adjusted under 35 U.S.C. 154(b) by 145 days.

This patent is subject to a terminal disclaimer.

(21) Appl. No.: 14/272,887

(22) Filed: May 8, 2014

(65) Prior Publication Data

US 2014/0238449 A1 Aug. 28, 2014

Related U.S. Application Data

(63) Continuation-in-part of application No. 13/404,474, filed on Feb. 24, 2012.

(51) Int. Cl.
*B44D 3/00* (2006.01)

(52) U.S. Cl.
CPC ..... *B44D 3/006* (2013.01)

(58) Field of Classification Search
CPC combination set(s) only.
See application file for complete search history.

(56) References Cited

U.S. PATENT DOCUMENTS 4,733,679 A 3/1988 Dolcater
4,809,722 A 3/1989 Pennise
4,832,066 A 5/1989 Shipman
5,050,626 A * 9/1991 Brockage et al. ..... 134/138
5,322,081 A 6/1994 Isaac
5,363,869 A * 11/1994 McDowell ..... B44D 3/006 134/104.2

(Continued)

FOREIGN PATENT DOCUMENTS

FR 2847494 5/2004
WO WO 2006100469 A2 * 9/2006 ..... A46B 17/06

OTHER PUBLICATIONS

USPTO; Non-Final Office Action issued in U.S. Appl. No. 13/404,474 dated Mar. 13, 2015.

(Continued)

*Primary Examiner* — Michael Barr
*Assistant Examiner* — Rita Adhlakha
(74) *Attorney, Agent, or Firm* — Fitch, Even, Tabin & Flannery LLP

(57) ABSTRACT

An apparatus for cleaning paint roller skins is provided. A rotatable roller skin holder is provided. An elongated hollow housing is attached to and surrounds the roller skin holder and has an end wall at a first end and with an opening at a second end opposite the first end, wherein the opening has a width that is wider than a diameter of the roller skins. A spray mechanism is attached to the housing for providing a spray along the length of the roller skin. A trigger handle is connected to the housing and the spray mechanism supports the housing and controls the flow of fluid to the spray mechanism, wherein fluid drains through the opening in the elongated hollow housing.

13 Claims, 9 Drawing Sheets

(56) References Cited

U.S. PATENT DOCUMENTS

| | | | | |
|---|---|---|---|---|
| 5,409,027 | A * | 4/1995 | Glunt | B44D 3/006 134/138 |
| 5,487,399 | A | 1/1996 | Hannah | |
| 5,505,220 | A * | 4/1996 | Gorecki | 134/138 |
| 6,116,255 | A | 9/2000 | Walter | |
| 7,325,556 | B2 | 2/2008 | Walter | |
| 7,383,847 | B2 | 6/2008 | Clark | |
| 7,640,941 | B2 | 1/2010 | Watters | |
| 7,866,329 | B2 | 1/2011 | Bates | |
| 8,449,693 | B2 | 5/2013 | Sheffield | |
| 8,505,562 | B2 | 8/2013 | McPhee, III | |
| 8,813,767 | B2 | 8/2014 | Parker | |
| 2006/0000497 | A1 | 1/2006 | Searle | |
| 2007/0089765 | A1* | 4/2007 | Clark | 134/103.2 |
| 2008/0035185 | A1* | 2/2008 | Baratta | 134/137 |
| 2008/0072932 | A1* | 3/2008 | Nicholas | 134/34 |
| 2008/0078429 | A1* | 4/2008 | Hoffmann | 134/178 |
| 2009/0000646 | A1 | 1/2009 | Durant | |
| 2010/0300500 | A1* | 12/2010 | McPhee, III | 134/198 |
| 2011/0089265 | A1* | 4/2011 | Gilpatrick et al. | 239/526 |
| 2012/0118333 | A1* | 5/2012 | Piccioni | A46B 17/06 134/33 |
| 2013/0220388 | A1 | 8/2013 | Egan | |
| 2013/0333733 | A1 | 12/2013 | Harrison | |

OTHER PUBLICATIONS

International Search Report and Written Opinion of the International Searching Authority for PCT/US2015/029862 dated Jul. 20, 2015.

USPTO; Final Office Action issued in U.S. Appl. No. 13/404,474 dated Sep. 2, 2015.

USPTO; Examiner Interview Summary issued in U.S. Appl. No. 13/404,474 dated Jun. 14, 2017.

USPTO; Non-Final Office Action issued in U.S. Appl. No. 13/404,474 dated Apr. 24, 2017.

* cited by examiner

PAINT ROLLER SKIN CLEANER

CROSS REFERENCE TO RELATED APPLICATIONS

This application is a continuation-in-part and claims priority under 35 U.S.C. §120 to U.S. patent application Ser. No. 13/404,474 entitled "Paint Roller Skin Cleaner," by Egan, filed Feb. 24, 2012, which is hereby incorporated by reference for all purposes.

BACKGROUND OF THE INVENTION

Field of the Invention

The invention relates to an apparatus for cleaning paint roller skins.

Paint roller skins are used on paint rollers for painting areas. To allow the paint roller skin to be reused, the paint roller skin should be cleaned. Various paint roller cleaning devices have been described in patents such as U.S. Pat. No. 4,733,679 by Dolcater, which issued Mar. 29, 1988, U.S. Pat. No. 4,809,722 by Pennise, which issued Mar. 7, 1989, U.S. Pat. No. 4,832,066 by Shipman, which issued May 23, 1989, U.S. Pat. No. 5,322,081 by Isaac, which issued Jun. 21, 1994, U.S. Pat. No. 5,409,027 by Glunt, which issued Apr. 25, 1995, U.S. Pat. No. 5,487,399 by Hannah, which issued Jan. 30, 1996, and U.S. Pat. No. 6,116,255 by Walter, which issued Sep. 12, 2000.

SUMMARY OF THE INVENTION

To achieve the foregoing and in accordance with the purpose of the present invention, an apparatus for cleaning paint roller skins is provided. A rotatable roller skin holder is provided. An elongated hollow housing is attached to and surrounds the roller skin holder and has an end wall at a first end and with an opening at a second end opposite the first end, wherein the opening has a width that is wider than a diameter of the roller skins. A spray mechanism is attached to the housing for providing a spray along the length of the roller skin. A trigger handle is connected to the housing and the spray mechanism supports the housing and controls the flow of fluid to the spray mechanism, wherein fluid drains through the opening in the elongated hollow housing.

In another manifestation of the invention, an apparatus for cleaning paint roller skins, wherein the paint roller skins have a length, is provided. A rotatable roller skin holder, which rotates around an axis of rotation, is provided. An elongated hollow housing is attached to and surrounds the roller skin holder with an end wall at a first end and with an opening at a second end opposite the first end, wherein the opening has a width that is wider than a diameter of the roller skins. A spray mechanism is attached to the elongated hollow housing for providing a spray along the length of the roller skin. The spray mechanism comprises a pipe with a length parallel to the axis of rotation of the rotatable roller skin holder and a plurality of nozzles along the length of the pipe where each nozzle provides a spray jet directed at the roller skin, wherein the spray jets provide a spray along the entire length of the roller skin, wherein the spray jets are directed at the paint roller skins but away from the axis of rotation of the roller skin holder with a sufficient force to rotate the roller skin holder around the axis of rotation. A trigger handle is connected to the pipe and provides support to the elongated hollow housing and the spray mechanism for supporting the elongated hollow housing and controlling the flow of fluid to the spray mechanism, wherein when the trigger handle rotates, the pipe rotates around an axis of rotation along the length of the pipe and wherein the nozzles are rotated around the length of the pipe. The trigger handle comprises a trigger movably connected to the trigger handle, and a fluid valve in fluid connection with the pipe, wherein the fluid valve is controlled by the trigger. A lock locks the trigger handle in at least three positions with respect to the elongated hollow housing, where fluid drains through the opening in the elongated hollow housing.

These and other features of the present invention will be described in more details below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
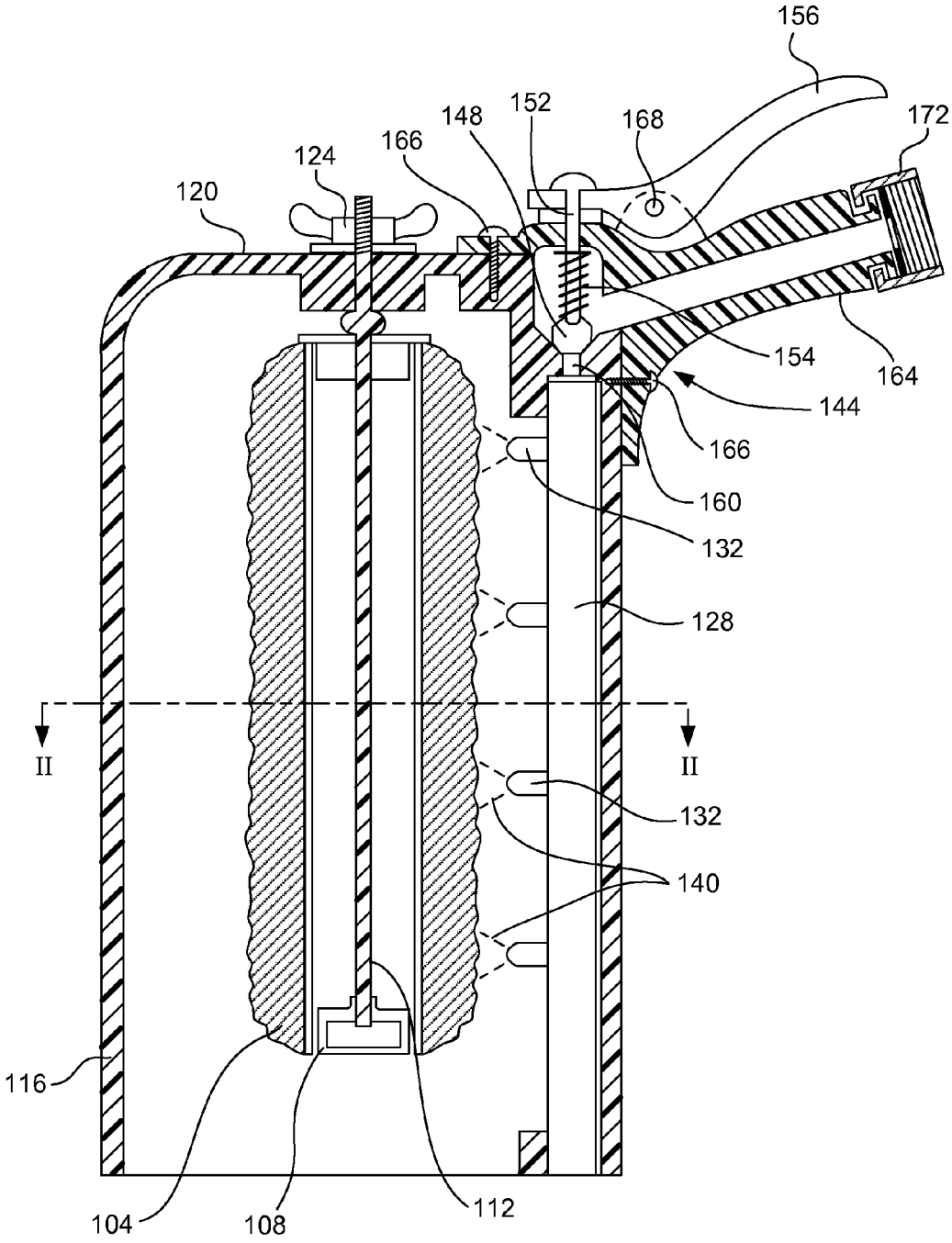
FIG. 1 is a cross-sectional view of an embodiment of the invention.

FIG. 1 is a cross-sectional view of an embodiment of the invention. This embodiment accommodates different size paint roller skins. In this embodiment, a 9 inch long paint roller skin 104 with an internal diameter of about 1⅜ inches. The paint roller skin 104 is slideably mounted on a roller support 108 with a shaft 112. The roller support 108 is able to freely rotate around the shaft 112. A housing 116 is disposed around the roller skin 104, the roller support 108 and the shaft 112. In this embodiment, the housing is cylindrical with a central axis that is collinear with the axis of rotation of the roller support 108, which is collinear with the shaft 112. The housing 116 has a length of 11½ inches so that the housing extends past the end of the paint roller skin 104 and has a diameter of 6 inches. A first end of the cylindrical housing 116 is open and the second end of the cylindrical housing 116 has an end wall 120. The shaft 112 is detachably mounted to the end wall 120 by a nut 124 that screws onto the shaft 112. In this embodiment, the nut 124 is a wing nut to allow for easier removal of the shaft 112.

Figure 2:
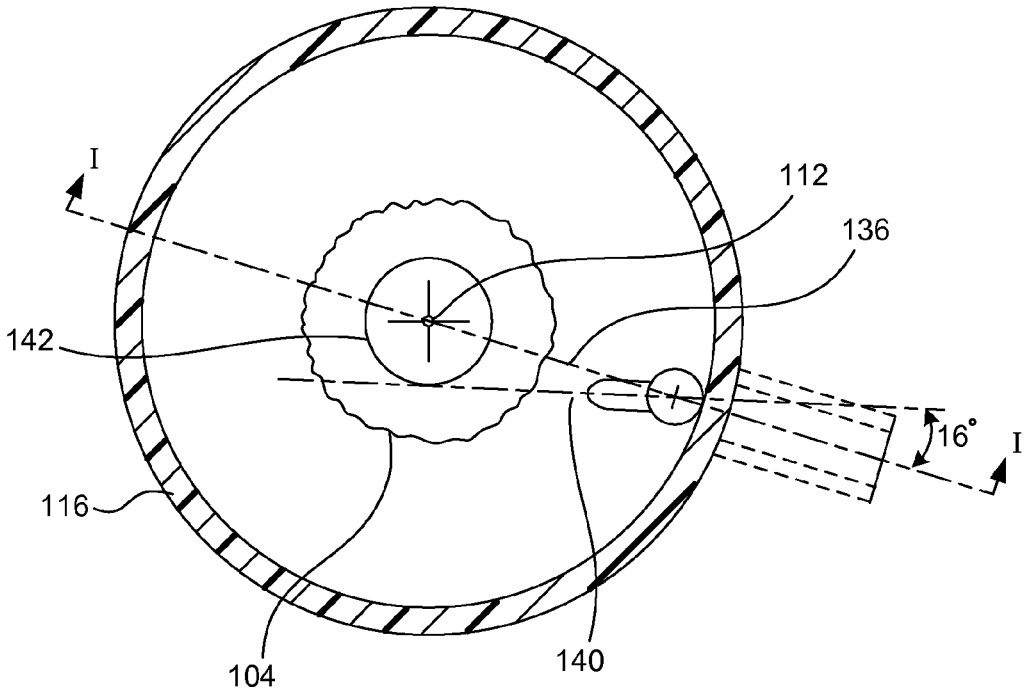
FIG. 2 is a top cross-sectional view of the embodiment shown in FIG. 1 along cut lines II-II.

Along the length of the wall of the housing 116 is a ½ inch diameter pipe 128. Four 60° spray jet nozzles 132 are spaced apart over the length of the pipe 128. FIG. 2 is a top cross-sectional view of the embodiment shown in FIG. 1 along cut lines II-II, where FIG. 1 is also a cross sectional view of FIG. 2 along cut lines I-I. In this embodiment, then length of the nozzle 132 makes a 16° angle with a radius 136 that passes from the shaft 112 to the base of the nozzle 132. The angle of the nozzle provides a jet 140 that tangentially contacts a layer 142 of the paint roller skin 104. Such a jet 140 is not directed to the shaft 112. A first end of the pipe 128 closest to first end of the housing 116 is closed.

A second end of the pipe 128 closest to the second end of the housing 116 and the end wall 120 is in fluid connection with a trigger handle 144. In this example, the trigger handle 144 comprises a rubber plunger 148 at the end of a metal plunger pin 152 and a spring 154 for pressing the rubber plunger 148 against a passage 160 for providing fluid to the second end of the pipe 128. A trigger 156 is connected to the metal plunger pin 152 and therefore controls the movement of the rubber plunger 148 and the flow of fluid into the pipe 128. The trigger handle 144 also comprises a fixed handle 164, which is connected to the housing 116. In this embodiment, the fixed handle 164 is bolted to the housing with screws 166, which provides sufficient mechanical strength so that the housing 116 may be completely supported by the fixed handle 164. In this embodiment a pivot pin 168 movably connects the trigger 156 to the fixed handle 164, so that the trigger 156 can move with respect to the fixed handle 164. A hose receptor 172 is connected to a passage through the fixed handle 164 and allows a water hose to be screwed onto the fixed handle 164.

Figure 3:
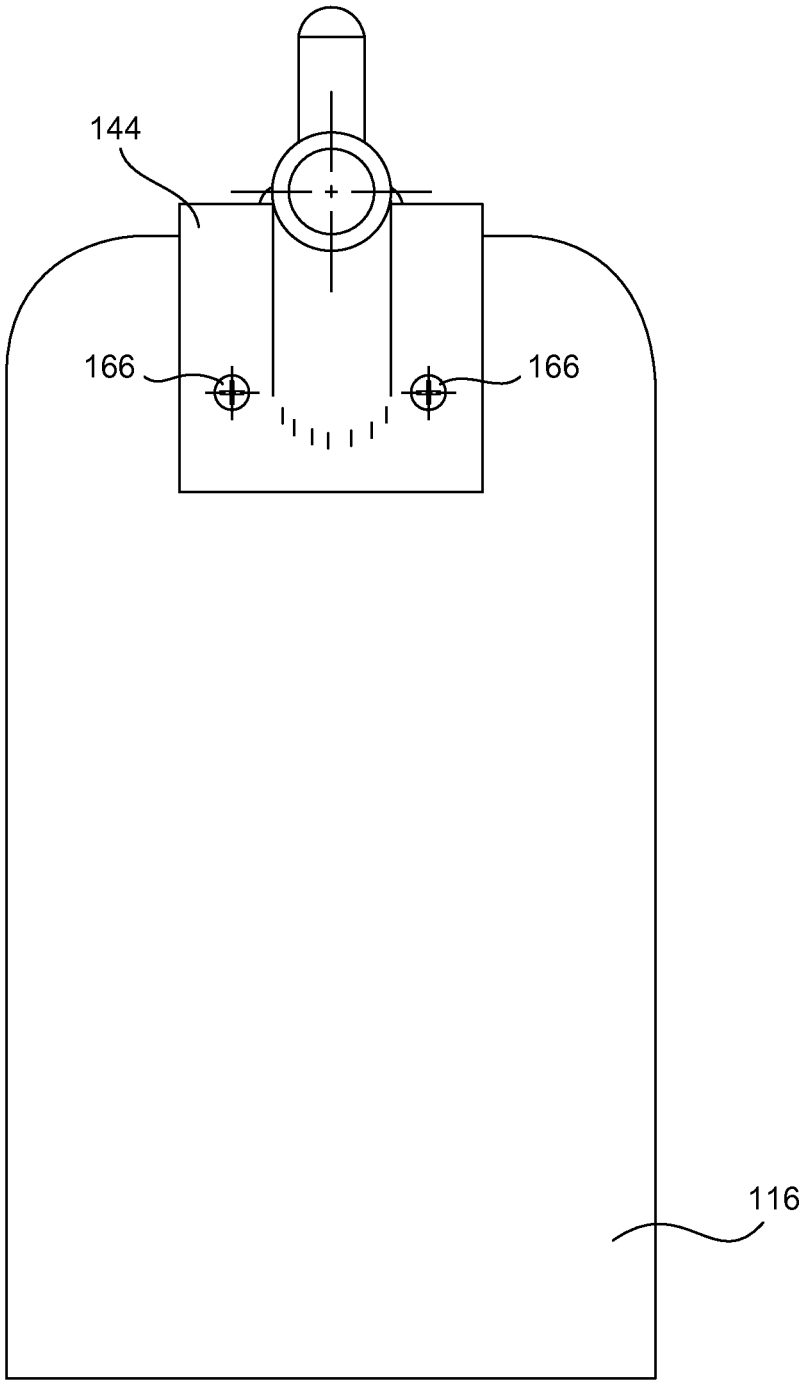
FIG. 3 is a side view of a housing.
Figure 4:
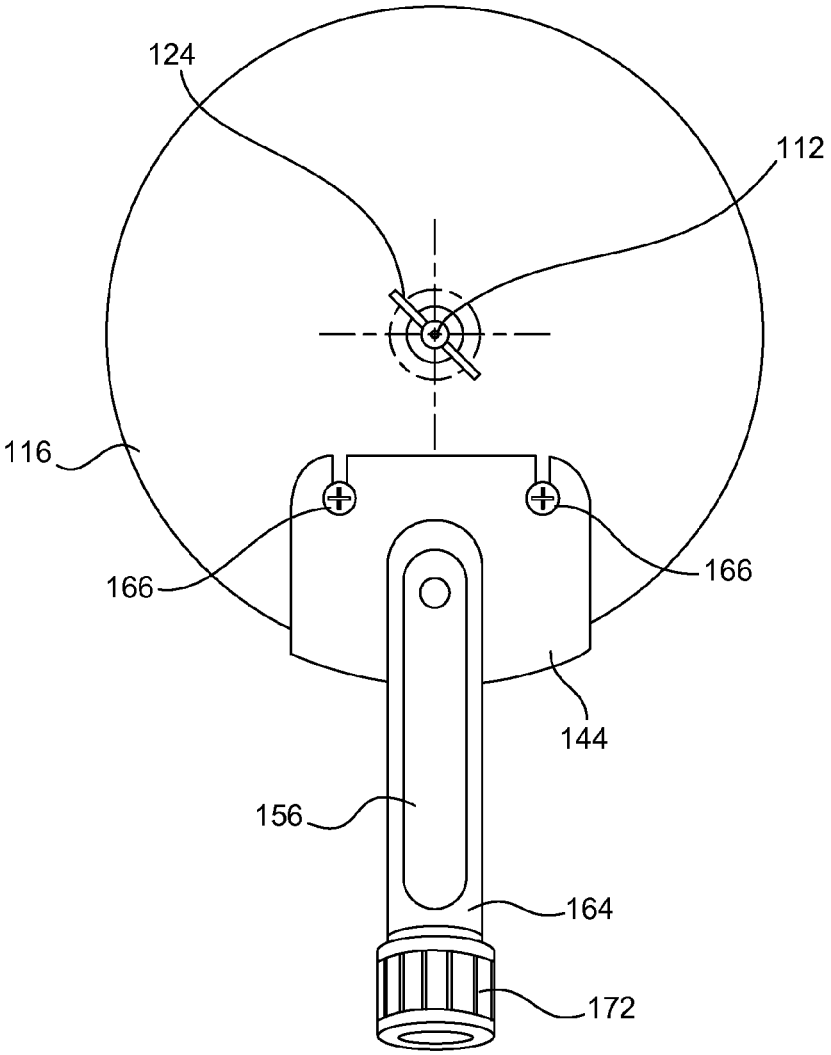
FIG. 4 is a top view of the housing.
Figure 5:
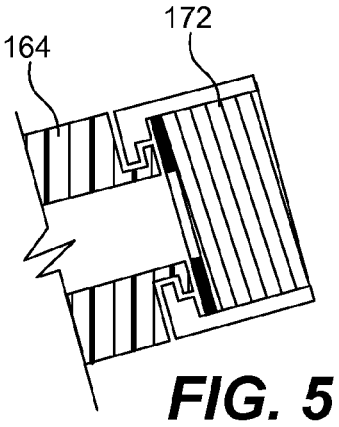
FIG. 5 is a more detailed cross-sectional view of a hose receptor.

FIG. 3 is a side view of the housing 116, showing how the fixed handle 164 is bolted to the housing 116 with screws 166. FIG. 4 is a top view of the housing 116. FIG. 5 is a more detailed cross-sectional view of the hose receptor 172 connected to the fixed handle 164.

In operation, a water hose, such as a garden hose, is screwed into the hose receptor 172. Water is flowed through the water hose. An unclean paint roller skin 104 is removed from a paint roller and slid onto the roller support 108 through the opening in the housing 116. In this example, the unclean paint roller skin 104 is unclean because the paint roller skin 104 was used to apply a water base paint. The fixed handle 164 is used to hold the housing 116 suspended in air, where the open end of the housing is vertically lower than the end wall 120. The trigger 156 is pressed, which removes the rubber plunger 148 from the passage 160 allowing water to flow from the hose through the fixed handle 164 into the pipe 128. The water flows through the pipe 128 into the four 60° spray jet nozzles 132 forming jets 140 of water, along the length of the paint roller skin 104. The jets 140 tangentially contacts a layer 142 of the paint roller skin 104, providing a tangential force which causes the paint roller skin 104 to spin. The water jets 140 clean the paint roller skin and the spinning creates a centrifugal force which forces the water and paint out of the paint roller skin to the housing. The spray jet nozzles 132 also control the flow of water, allowing less water to be used to conserve water and provide less waste water. The trigger 156 is released, which allows the rubber plunger 148 to block the passage 160, stopping the flow of water to the pipe 128, which stops the jets 140. Rotational momentum causes the paint roller skin 104 to continue to spin, which causes water and paint to continue to be forced from the paint roller skin 104 under centrifugal force. Eventually, the paint roller skin 104 stops spinning and the paint roller skin 104 is removed from the support 108 through the opening in the housing 116. In this embodiment of the invention, the spinning of the paint roller skin 104 removes enough water to allow the paint roller skin 104 to be used without additional drying. Providing four separate nozzles instead of a single slit reduces the needed water flow, which conserves water.

This embodiment of the invention provides a quick cleaning and drying of paint roller skins to allow the roller skins to be reused quickly. This embodiment also allows the housing and spray mechanism to be held with one hand, where the one hand is able to completely control the flow of the spray with the one hand. The embodiments light weight design further helps provide one handed control. The embodiment of the invention also provides an inexpensive design. Since in this embodiment, the roller support 108 may be removed from the housing 116, different roller supports may be used to accommodate different size paint roller skins.

Figure 6:
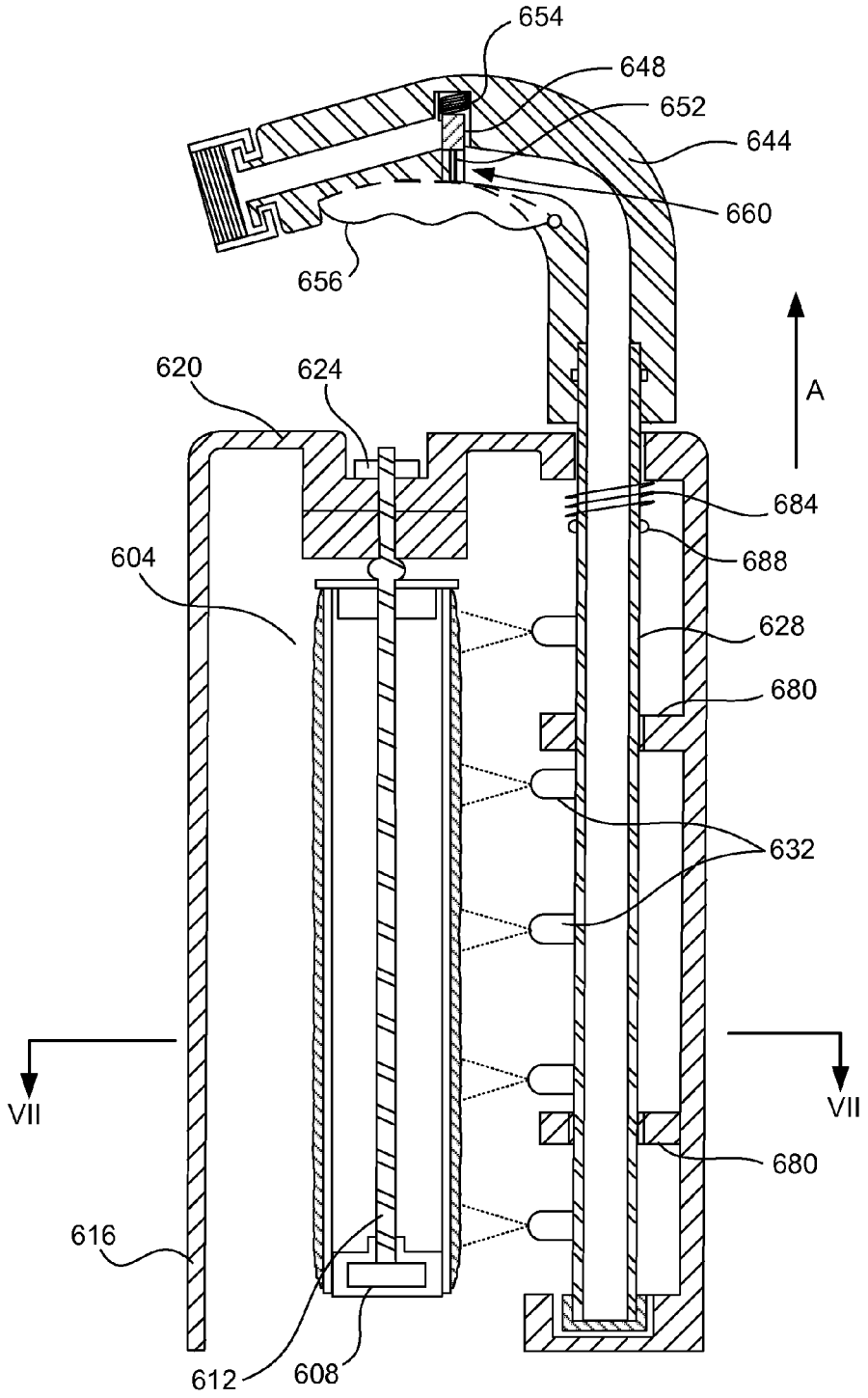
FIG. 6 is a cross-sectional view of another embodiment of the invention.

FIG. 6 is a cross-sectional view of another embodiment of the invention. This embodiment accommodates roller skins with different nap thicknesses. In this embodiment, a 9 inch long paint roller skin 604 with an internal diameter of about 1⅜ inches. The paint roller skin 604 is slideably mounted on a roller support 608 with a shaft 612. The roller support 608 is able to freely rotate around the shaft 612. A housing 616 is disposed around the roller skin 604, the roller support 608 and the shaft 612. The housing 616 has a length of 11½ inches so that the housing extends past the end of the paint roller skin 604 and has a diameter of 6 inches. A first end of the housing 616 is open and the second end of the housing 616 has an end wall 620. The shaft 612 is detachably mounted to the end wall 620 by a nut 624 that screws onto the shaft 612.

Figure 7:
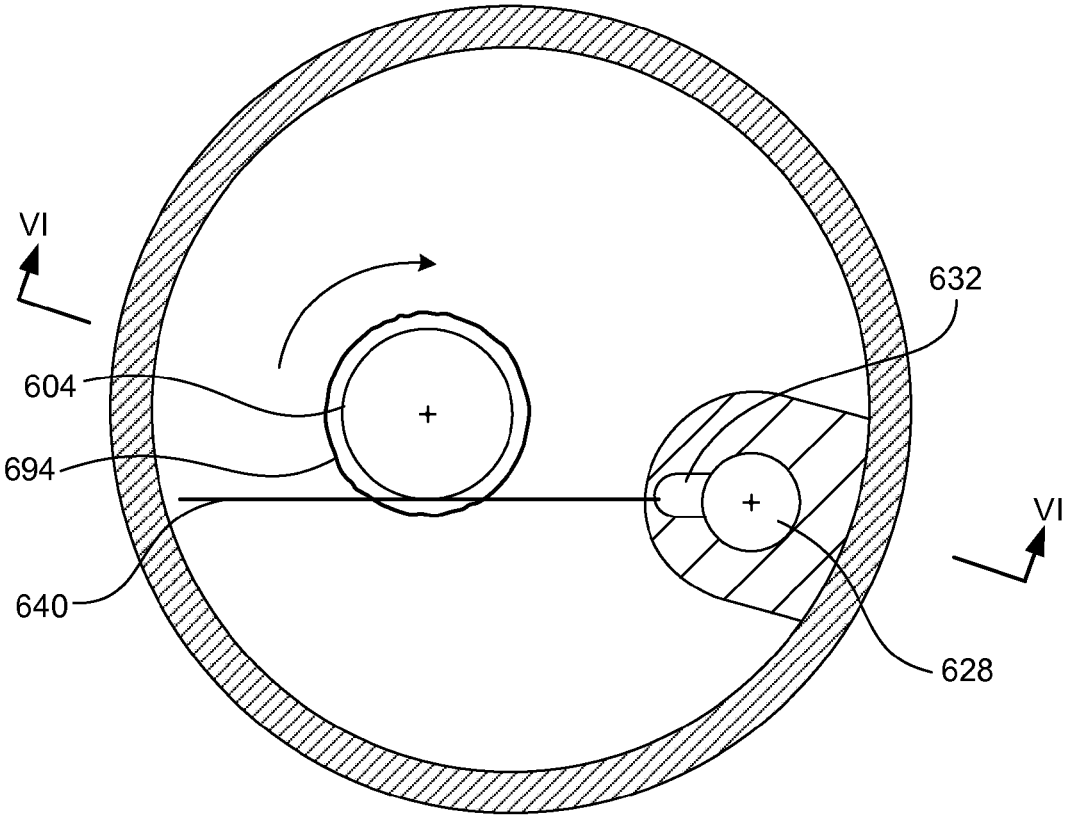
FIG. 7 is a top cross-sectional view of the embodiment shown in FIG. 6 along cut lines VII-VII.

Along the length of the wall of the housing 616 is a ½ inch diameter pipe 628. Five 80° spray jet nozzles 632 are spaced apart over the length of the pipe 628. FIG. 7 is a top cross-sectional view of the embodiment shown in FIG. 6 along cut lines VII-VII, where FIG. 6 is also a cross sectional view of FIG. 7 along cut lines VI-VI. In this embodiment, the shaft 612 is not at the center of the housing 616.

A second end of the pipe 628 closest to the second end of the housing 616 and the end wall 620 is in fluid connection with a trigger handle 644. In this example, the trigger handle 644 comprises a rubber plunger 648 at the end of a metal plunger pin 652 and a trigger spring 654 for pressing the rubber plunger 648 against a passage 660 for providing fluid to the second end of the pipe 628. A trigger 656 is connected to the metal plunger pin 652 and therefore controls the movement of the rubber plunger 648 and the flow of fluid into the pipe 628. The trigger handle 644 is connected to the housing 616. In this embodiment, the trigger handle 644 is connected to the second end of the pipe 628. Pipe supports 680 are connected to the walls of the housing 616. The pipe 628 passes through the pipe supports 680. A pipe spring 684 extends between the end wall 620 and a stop 688 connected to the pipe 628.

Figure 8:
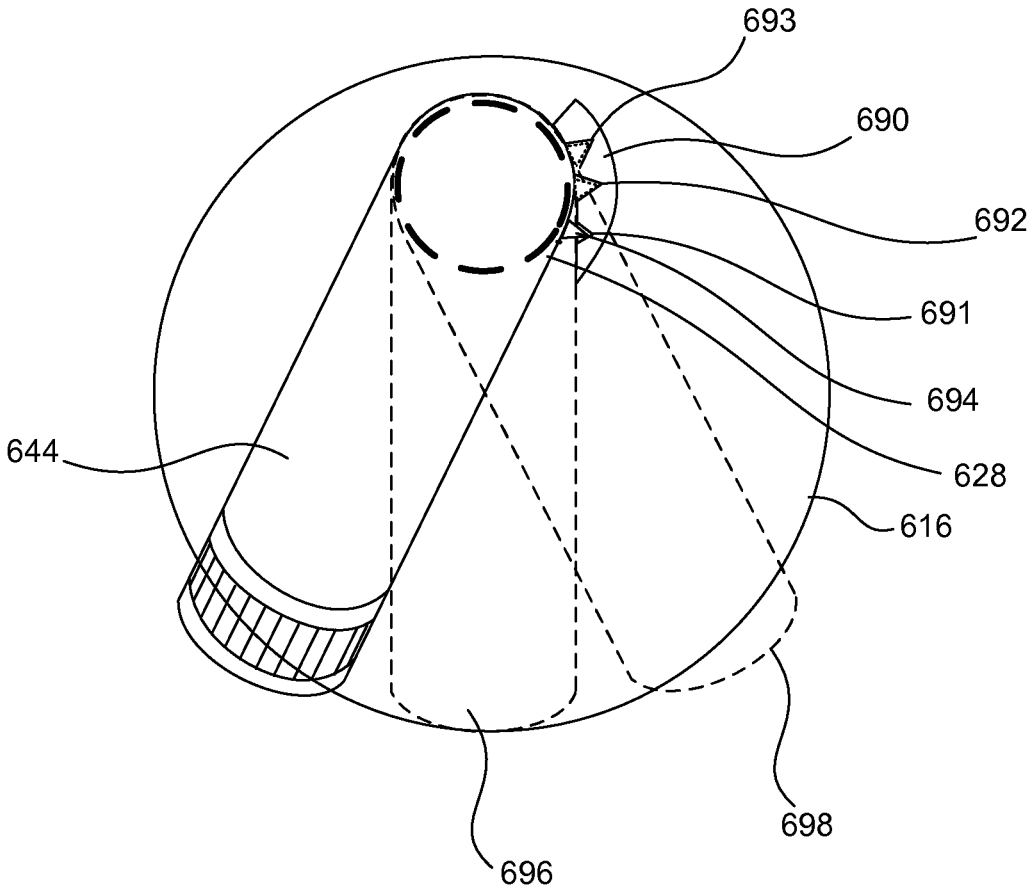
FIG. 8 is a top view of the housing.

FIG. 8 is a top view of the housing 616. A lock 690 attached to the housing 616 comprises a first notch 691. A tooth 694 connected to the trigger handle 644 is in the first notch 691 of the lock 690. The tooth 694 and lock 690 are able to keep the trigger handle 644 and the housing 616 in a fixed first position. In order to change the relative position of the trigger handle 644 and housing 616 the trigger handle 644 is moved in a direction as indicated by arrow A in FIG. 6 against a force provided by the pipe spring 684, which lifts the tooth 694 out of the first notch 691, which allows rotation of the trigger handle 644 with respect to the housing 616 to a second fixed position 696 or third fixed position 698 by placing the tooth in a second notch 692 or third notch 693, respectively. When the tooth 694 is moved adjacent to a desired notch, the pipe spring 684 pulls the tooth 694 into the desired notch to lock the relative positions of the trigger handle 644 and the housing 616.

In operation, a water hose, such as a garden hose, is screwed into the hose receptor. Water is flowed through the water hose. An unclean paint roller skin 604 is removed from a paint roller and slid onto the roller support 608 through the opening in the housing 616. In this example, the unclean paint roller skin 604 is unclean because the paint roller skin 604 was used to apply a water base paint. The trigger handle 644 is used to hold the housing 616 suspended in air, where the open end of the housing is vertically lower than the end wall 620. The trigger 656 is pressed, which removes the rubber plunger 648 from the passage 660 allowing water to flow from the hose through the trigger handle 644 into the pipe 628. The water flows through the pipe 628 into the five 80° spray jet nozzles 632 forming jets 640 of water, along the length of the paint roller skin 604. The jets 640 tangentially contact the paint roller skin 604, providing a tangential force which causes the paint roller skin 604 to spin. The water jets 640 clean the paint roller skin and the spinning creates a centrifugal force which forces the water and paint out of the paint roller skin to the housing. The spray jet nozzles 632 also control the flow of water, allowing less water to be used to conserve water and provide less waste water. The trigger 656 is released, which allows the rubber plunger 648 to block the passage 660, stopping the flow of water to the pipe 628, which stops the jets 640. Rotational momentum causes the paint roller skin 604 to continue to spin, which causes water and paint to continue to be forced from the paint roller skin 604 under centrifugal force. Eventually, the paint roller skin 604 stops spinning and the paint roller skin 604 is removed from the support 608 through the opening in the housing 616. In this embodiment of the invention, the spinning of the paint roller skin 604 removes enough water to allow the paint roller skin 604 to be used without additional drying.

This embodiment of the invention provides a quick cleaning and drying of paint roller skins to allow the roller skins to be reused quickly. This embodiment also allows the housing and spray mechanism to be held with one hand, where the one hand is able to completely control the flow of the spray with the one hand. The embodiment's light weight design further helps provide one handed control. The embodiment of the invention also provides an inexpensive design. Since in this embodiment, the roller support 608 may be removed from the housing 616, different roller supports may be used to accommodate different size paint roller skins.

In this example, the paint roller skin 604 has a nap 694 of ¼ inch. In such a case, the middle of the jet 640 is tangential to the inner surface of the paint roller skin 604.

Figure 9:
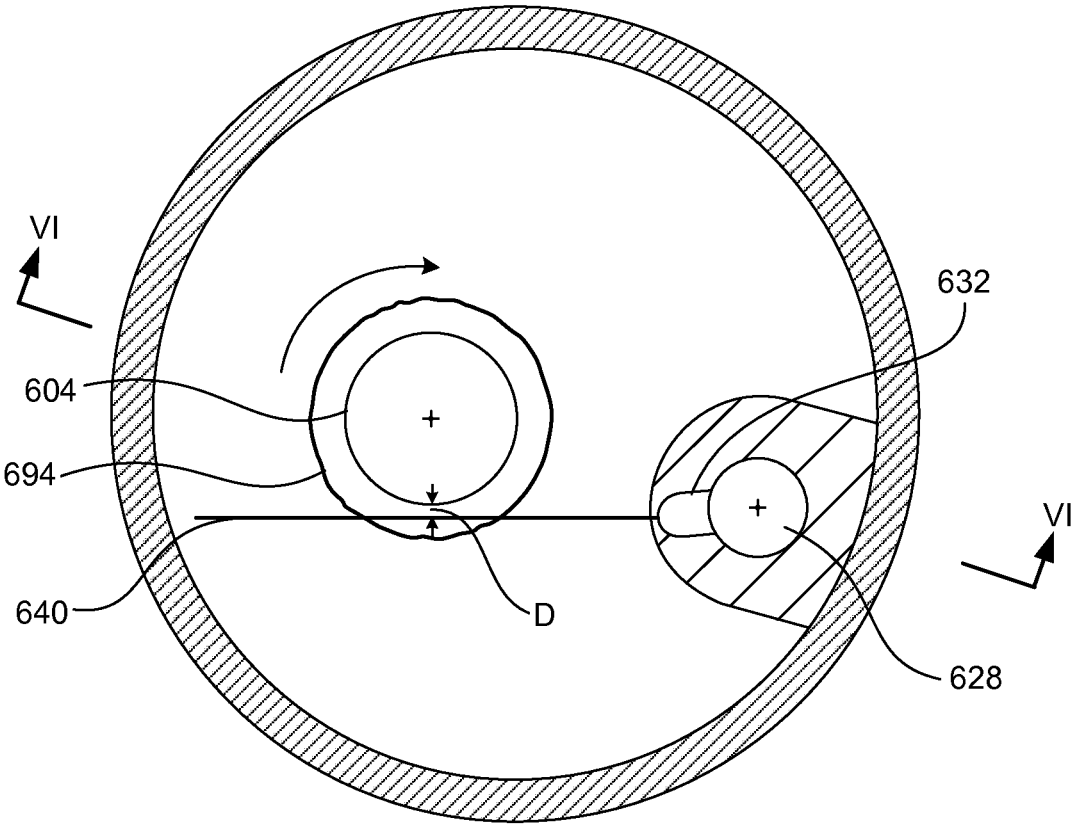
FIG. 9 is a top cross-sectional view of the embodiment shown in FIG. 6 along cut lines VII-VII with a different roller skin.

FIG. 9 is a top cross-sectional view as shown in FIG. 7, except that the nap 694 of the paint roller skin 604 is ½ inch. In such a case, the trigger handle 644 is moved to the second fixed position 696, by moving the tooth to the second notch 692. In this trigger handle 644 position the middle of the jet 640 is directed to approach the inner surface of the paint roller skin 604 by a closest distance of D of ¼ inch.

Figure 10:
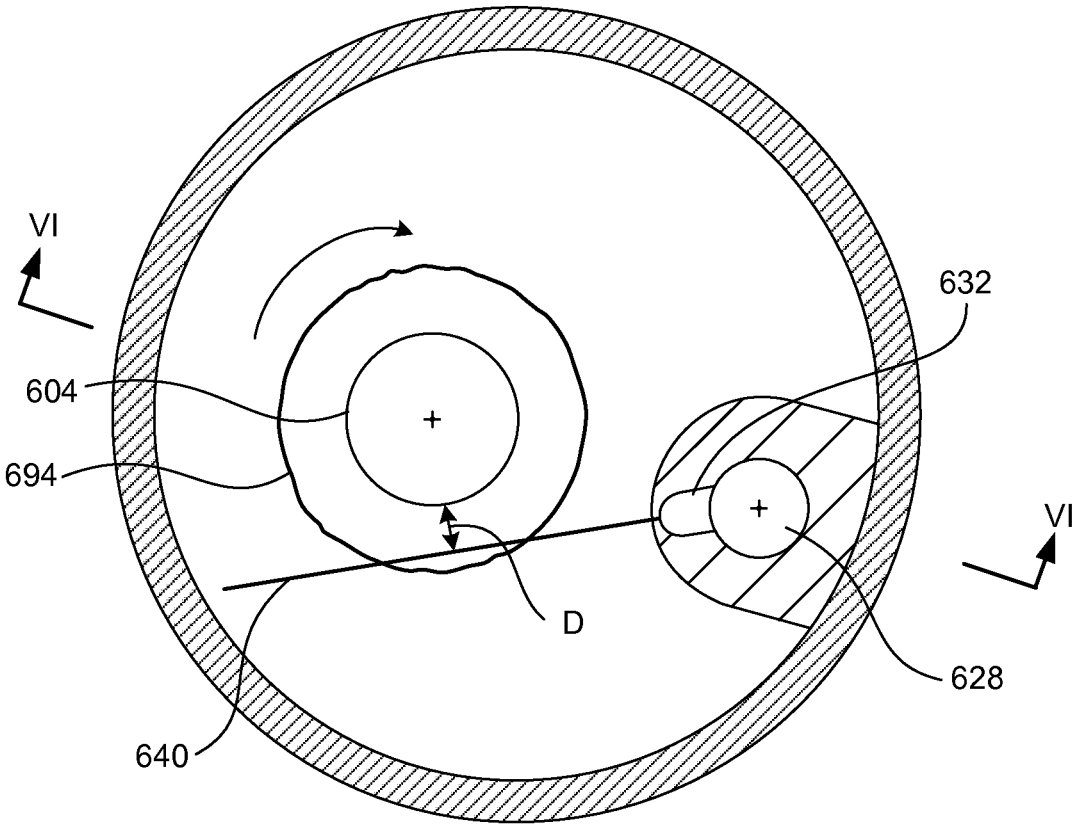
FIG. 10 is a top cross-sectional view of the embodiment shown in FIG. 6 along cut lines VII-VII with a different roller skin.

FIG. 10 is a top cross-sectional view as shown in FIG. 7, except that the nap 694 of the paint roller skin 604 is ¾ inch. In such a case, the trigger handle 644 is moved to the third position 698, by moving the tooth to the third slot 693. In this trigger handle 644 position the middle of the jet 640 is directed to approach the inner surface of the paint roller skin 604 by a closest distance of D of ½ inch.

This embodiment provides a handle that is able to adjust and lock for roller skins of different nap thicknesses. This embodiment provides 3 locking positions, from the three notches 691-693. Such adjustments allows for improved cleaning and drying of the different roller skins with different naps. It has been found that roller skins with different size naps require different jet angles in order to provide optimal cleaning. Preferably, the lock allows for at least 2 locking positions. More preferably, the lock allows for at least 3 locking positions. In this embodiment, the length of the pipe 628 is parallel to the length of the shaft 612, which is the axis of rotation of the paint roller skin 604 and roller skin holder, comprising the shaft 612. Rotating the trigger handle 644 rotates the pipe 628 around an axis parallel to the length of the pipe 628, which causes the nozzles 632 to be rotated perpendicular to the length of the shaft 612. This allows the jets 640 from the different nozzles 632 to be set at the same distance D from the inner surface of the paint roller skin 604.

In a preferred embodiment, the integration of a trigger handle to allow a quick shut off of the water flow, while supporting the housing, and the nozzles that provide narrowly defined jets that provide tangential spinning, while minimizing water flow improve the drying capabilities of the invention, over a device where water flow is not shut off quickly or where the water jets are not so defined and do not sufficiently reduce water flow. Therefore, in a preferred embodiment, these different elements work in a synergistic manner to provide cleaning and drying device.

Preferably, the housing is made of plastic to make the housing lighter and easier to clean. Embodiments of the invention may be able to clean more than paint from the roller skins. For example, texturing material may be cleaned from the paint roller skins used to apply texturing material.

Because embodiments of the invention do not need additional drying, reuse of the paint roller skins may be provided much more quickly, without waiting for the paint roller skins to dry. In addition, extra work, such as squeezing the paint roller skins, is not needed.

For embodiments with different size diameter housing, the nozzle angle with a radius, the spray angle, and the number of jet nozzles may be different to provide jets along the length of the roller skin with sufficient tangential force to spin the roller skins at a speed to provide both cleaning and drying. For example, if the housing has a diameter of less than 6 inches, the jet nozzles are placed closer to the roller skin. In such a case, the angle that the length of the nozzle makes with the radius of the housing would be greater than 16°. Preferably, the angle that the length of the nozzle makes with the radius is between 6° to 25°. Preferably, the jet nozzles provide a spray angle between 45° and 75°. In such an embodiment, then length of the nozzle makes a 16° angle with a radius that passes from the shaft to the base of the nozzle. The angle of the nozzle provides a jet that tangentially contacts a layer of the paint roller skin. Such a jet is not directed to the shaft. For embodiments with a removable roller support to provide interchangeable roller supports to accommodate different size roller paint skins of different lengths or different diameters, if roller skins of different diameters are used, the trigger handle and pipe may be rotated to rate the spray jet nozzles accommodate the different diameters, where lock positions are set for the different roller skin diameters.

While this invention has been described in terms of several preferred embodiments, there are alterations, modifications, permutations, and various substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and various substitute equivalents as fall within the true spirit and scope of the present invention.

What is claimed is:

1. An apparatus for cleaning a paint roller skin, wherein the paint roller skin has a length, comprising:

a generally cylindrical hollow housing with an end wall at a first end and with an opening at a second end opposite the first end, wherein the opening has a width that is wider than a diameter of the paint roller skin;

a rotatable roller skin holder including a shaft coupled to the end wall such that the shaft is generally parallel to a central axis of the housing and the shaft is surrounded by the housing wherein the paint roller skin is slidably mounted onto the shaft through the opening in the housing so that the housing is disposed around the paint roller skin;

a pipe spray mechanism having a longitudinal axis, attached to the housing such that the pipe spray mechanism is rotatable around an axis parallel to a length of the shaft, for providing a spray along the length of the paint roller skin when the paint roller skin is mounted on the roller skin holder;

a trigger handle connected to the end wall and the pipe spray mechanism and comprising:

a handle providing support to the housing and providing fluid flow to the spray mechanism, the handle configured for a user to hold, by one hand, the apparatus with the first end generally above the second end, the handle further configured to be rotatable whereby rotation of the handle rotates the pipe spray mechanism around the axis parallel to the length of the shaft;

a fluid valve in fluid connection with the handle; and a trigger movably connected to the handle and controlling the fluid valve, wherein the trigger is configured to be operable by the one hand while holding the handle, wherein the sprayed fluid drains through the opening in the housing, wherein, upon operation of the trigger, a spray is provided from the spray mechanism along at least a portion of the length of the paint roller skin causing the paint roller skin to spin on the shaft causing fluid to be forced from the paint roller skin, wherein, upon release of the trigger, the paint roller skin continues to spin on the shaft causing fluid to continue to be forced from the paint roller skin, wherein during the cleaning of the paint roller skin the opening remains open while fluid drains from the apparatus directly through the opening in the housing, and wherein the paint roller skin is removed from the shaft through the opening in the housing; and a lock coupled to the end wall for providing a plurality of locking positions between the housing and the handle.

2. The apparatus, as recited in claim 1, wherein the pipe spray mechanism comprises a plurality of nozzles where each nozzle provides a spray jet directed at the paint roller skin when the trigger is operated.

3. The apparatus, as recited in claim 2, wherein each spray jet provided by the nozzles has a spray angle of between 45° and 75°.

4. The apparatus, as recited in claim 3, wherein the housing has a length and the length of the paint roller skin is shorter than the length of the housing.

5. The apparatus, as recited in claim 1, wherein the spray jets provide a water spray along the entire length of the paint roller skin.

6. The apparatus, as recited in claim 5, further comprising a hose receptor in fluid connection with the handle.

7. The apparatus, as recited in claim 1, wherein the lock comprises a plurality of notches, wherein each notch of the plurality of notches provides a locking position of the plurality of locking positions.

8. The apparatus, as recited in claim 7, wherein the trigger handle further comprises a tooth for seating within the plurality of notches.

9. The apparatus, as recited in claim 8, wherein the apparatus further comprises a spring coupled to the housing and to the pipe spray mechanism for pulling the tooth into one of the plurality of notches, whereby the relative positions of the trigger handle and the housing are locked.

10. The apparatus, as recited in claim 9, further comprising a hose receptor in fluid connection with the trigger handle.

11. The apparatus, as recited in claim 1, wherein rotating the nozzles perpendicular to the length of the shaft locates the spray jets tangential to an inner surface of the paint roller skin.

12. The apparatus, as recited in claim 1, wherein the plurality of locking positions is at least two locking positions.

13. The apparatus, as recited in claim 1, wherein a distance between the longitudinal axis of the pipe spray mechanism and a longitudinal axis of the shaft is constant.

* * * * *